US008894003B2

(12) United States Patent
Shai

(10) Patent No.: US 8,894,003 B2
(45) Date of Patent: Nov. 25, 2014

(54) AIR VEHICLE AND METHOD FOR OPERATING AN AIR VEHICLE

(75) Inventor: Mordechai Shai, Hod-Hasharon (IL)

(73) Assignee: Israel Aerospace Industries Ltd., Lod (IL)

( * ) Notice: Subject to any disclaimer, the term of this patent is extended or adjusted under 35 U.S.C. 154(b) by 392 days.

(21) Appl. No.: 13/260,618

(22) PCT Filed: Apr. 13, 2010

(86) PCT No.: PCT/IL2010/000298

§ 371 (c)(1),
(2), (4) Date: Sep. 27, 2011

(87) PCT Pub. No.: WO2010/119442

PCT Pub. Date: Oct. 21, 2010

(65) Prior Publication Data

US 2012/0018572 A1 Jan. 26, 2012

(30) Foreign Application Priority Data

Apr. 16, 2009 (IL) ..... 198124

(51) Int. Cl.

| | |
|---|---|
| ***B64C 27/00*** | (2006.01) |
| ***F42B 10/62*** | (2006.01) |
| ***F42B 10/64*** | (2006.01) |
| ***F42B 10/14*** | (2006.01) |

(52) U.S. Cl.

CPC ..... *F42B 10/14* (2013.01); *F42B 10/62* (2013.01); *F42B 10/64* (2013.01)

USPC ..... 244/39; 49/3.27; 49/3.28; 49/3.29

(58) Field of Classification Search

USPC ..... 244/49, 3.27, 3.28, 3.29

See application file for complete search history.

(56) References Cited

U.S. PATENT DOCUMENTS

| | | | | |
|---|---|---|---|---|
| 2,541,922 | A | 2/1951 | Hosford | |
| 2,788,182 | A | 4/1957 | Brenden et al. | |
| 3,147,938 | A | 9/1964 | Danner | |
| 3,529,790 | A | 9/1970 | Buch | |
| 3,790,103 | A | 2/1974 | Peoples | |
| 4,415,132 | A | 11/1983 | Shirk | |
| 4,453,426 | A | 6/1984 | Groutage et al. | |
| 4,842,218 | A * | 6/1989 | Groutage et al. | 244/3.28 |
| 4,998,689 | A * | 3/1991 | Woodcock | 244/46 |
| 5,141,175 | A | 8/1992 | Harris | |
| 5,154,370 | A | 10/1992 | Cox et al. | |
| 5,322,243 | A * | 6/1994 | Stoy | 244/45 A |
| 5,417,393 | A | 5/1995 | Klestadt | |
| 6,601,795 | B1 * | 8/2003 | Chen | 244/46 |

(Continued)

FOREIGN PATENT DOCUMENTS

| | | | |
|---|---|---|---|
| EP | 0 622 604 | A2 | 11/1994 |
| WO | WO 2007/030687 | A2 | 3/2007 |

*Primary Examiner* — Isam Alsomiri
*Assistant Examiner* — Assres H Woldemaryam
(74) *Attorney, Agent, or Firm* — Oliff PLC

(57) ABSTRACT

An air vehicle is provided, including a body having a longitudinal axis, a wing arrangement rotatably mounted to the body with respect to the longitudinal axis, a direction control arrangement for controlling the direction of motion of the body, and an actuation mechanism operable for selectively and controllably rotating the wing arrangement with respect to the body through at least a desired first angular displacement about the longitudinal axis. Methods for operating air vehicles are also provided.

23 Claims, 4 Drawing Sheets

(56) References Cited

U.S. PATENT DOCUMENTS

| | | | | |
|---|---|---|---|---|
| 6,745,979 | B1 * | 6/2004 | Chen | 244/46 |
| 6,923,404 | B1 * | 8/2005 | Liu et al. | 244/46 |
| 7,165,742 | B2 * | 1/2007 | Kusic | 244/34 R |
| 7,267,298 | B2 * | 9/2007 | Leininger | 244/3.24 |
| 7,825,359 | B2 * | 11/2010 | Kusic | 244/3.22 |
| 8,210,465 | B2 * | 7/2012 | Merems et al. | 244/8 |
| 8,513,581 | B2 * | 8/2013 | Geswender et al. | 244/3.24 |
| 2002/0195522 | A1 * | 12/2002 | Kusic | 244/75 R |
| 2005/0211827 | A1 | 9/2005 | Barocela | |
| 2007/0018033 | A1 * | 1/2007 | Fanucci et al. | 244/3.27 |

* cited by examiner

AIR VEHICLE AND METHOD FOR OPERATING AN AIR VEHICLE

FIELD OF THE INVENTION

This invention relates to air vehicles and to operation of air vehicles, in particular maneuverable winged vehicles, and to the configuration and control of such vehicles.

BACKGROUND OF THE INVENTION

A variety of air vehicle configurations are known.

For example, by way of general background, U.S. Pat. No. 5,417,393 discloses a vehicle such as a missile, which includes an aerodynamically shaped missile body having a longitudinal centerline, a set of control surfaces joined to the missile body and a propulsion system operable to drive the missile body forwardly. A cylindrical rotational bearing is mounted on the missile body with its cylindrical axis parallel to the longitudinal centerline of the missile body. A flexible band wing is supported from the rotational bearing.

Further by way of general background, U.S. Pat. No. 3,790,103 discloses a rotatable sleeve with attached clipped double delta shaped fins for mounting on a missile body so that the fins may achieve a position of symmetry with respect to incident air flow thereon without spinning-up.

Further by way of general background, U.S. Pat. No. 4,453,426 discloses a moveable wing aircraft including a quick release, attachment mechanism for carrying the aircraft on a bomb rack or other carrier and a mechanism for deploying the moveable wing from its captive carry position to its extended free flight position are disclosed. The aircraft includes an elongate fuselage, a portion of the top surface of which is substantially flat in order to accommodate the moveable wing. The moveable wing is positionable between a captive carry position in which it is aligned with the longitudinal axis of the fuselage and an extended free flight position. The single, moveable wing is pivoted around a central point from its captive carry position to its extended free flight position such that it is substantially perpendicular to the aircraft fuselage. The quick release mechanism extends through apertures in the wing in its captive carry position and is spring biased to retract through the wing and into the aircraft fuselage when released from the bomb rack or other carrier. The deployment mechanism includes a spring loaded cable and pulley arrangement and serves to connect the moveable wing to the fuselage and to bias it from its captive carry position to its extended free flight position when activated upon release of the quick release mechanism.

U.S. Pat. No. 2,788,182 discloses a coordinated wing and aileron mechanism especially suitable for guided missiles.

The contents of these references are incorporated herein in their entirety.

SUMMARY OF THE INVENTION

According to a first aspect of the invention there is provided an air vehicle, comprising:

a body having a longitudinal axis;

a wing arrangement rotatably mounted to said body with respect to said longitudinal axis;

direction control arrangement for controlling the direction of motion of the body; and an actuation mechanism operable for selectively and controllably rotating said wing arrangement with respect to said body through at least a desired first angular displacement about said longitudinal axis.

According to at least this aspect of the invention, the said actuation mechanism is different from the said direction control arrangement, and/or said actuation mechanism is configured for selectively and controllably rotating said wing arrangement with respect to said body through at least said desired first angular displacement about said longitudinal axis, independently of operation of said direction control arrangement.

In at least some embodiments the said direction control arrangement comprises a plurality of fins mounted on said body. The fins may provide longitudinal stability, and/or for pitch control and/or yaw control for the vehicle. Additionally or alternatively, the direction control system may comprise a thrust vector control system. In at least some embodiments, the vehicle further comprises a powerplant or any other suitable propulsion system operative for providing propulsion and thus forward motion to said vehicle, at least during a part of operation thereof.

The wing arrangement is rotatably mounted to said body via a rolling mechanism, and together the wing arrangement and rolling mechanism are comprised in a steering assembly.

In at least some embodiments the rolling mechanism comprises a sleeve configured for rotation about said longitudinal axis with respect to said body, and wherein said wing arrangement is mounted to said sleeve for enabling controllable rotation therewith about said longitudinal axis. The wing arrangement comprises a port wing portion and a starboard wing portion, and the wing arrangement comprises a unitary structure mounted in a general tangential relationship with respect to said sleeve, in at least some embodiments of the invention.

In at least other embodiments, the port and starboard wing portions are each mounted at opposite sides of the sleeve, for example in diametrically opposed relationship. Such wing portions may be fixedly mounted to the sleeve, or alternatively may be configured as monoblock wings, in which each wing portion is rotatable about its respective pitch axis.

In some embodiments, the actuation mechanism is operable during flight of said vehicle, and the sleeve is configured for freely rotating with respect to said body about said longitudinal axis. In some embodiments, the actuation mechanism is comprised in said wing arrangement, said actuation mechanism being configured for controllably and selectively inducing an aerodynamically generated rolling moment to said wing arrangement with respect to said body about said longitudinal axis to provide the desired first angular displacement about the longitudinal axis.

In some embodiments, the actuation mechanism is coupled to the wing arrangement. For example, the wing arrangement may comprise aerodynamic elements coupled to said wing arrangement, and configured for selectively inducing an aerodynamically generated rolling moment to said wing arrangement with respect to said body about said longitudinal axis. The aerodynamic elements comprise ailerons mounted to said wing arrangement, or otherwise comprised or coupled with respect to the wing arrangement, and the ailerons are controllably operable to selectively induce said aerodynamically generated rolling moment responsive to differential deflection of said ailerons when the vehicle is in a flight regime with respect to said wing arrangement by generating different lift forces on each wing portion. Alternatively, in other embodiments, the wing arrangement is configured such that each wing portion may be independently and differentially rotated about its respective pitch axis to provide a similar effect.

Optionally, each said aileron (or monoblock wing portion) is deflectable in direction and/or with a magnitude of angular displacement that is/are independent of the deflection (direction and/or magnitude) of other ailerons (or the other monoblock wing portion); this feature allows deployment of the wing arrangement, in embodiments in which the wing arrangement is deployable, to be carried out via aerodynamically induced forces. Further optionally, the ailerons are operable to synchronously deflect in the same direction, enabling said ailerons to further operate as flaps, and are also referred to herein as flaperons. A feature of the actuation mechanism based on such ailerons or flaperons is that control of the lift vector for the wing arrangement may be provided in a relatively simple and effective manner.

Alternatively, the actuation mechanism comprises a drive mechanism engaged to said sleeve and configured for selectively and controllably driving rotation of said sleeve, together with said wing arrangement, with respect to said body about said longitudinal axis through said first angular displacement. For example, the drive mechanism may comprise any one of a rotary motor and a linear motor mechanically coupled to said sleeve and configured for providing said first angular displacement, or may include pneumatic or hydraulic drive mechanisms, or any other suitable drive mechanism. Thus, operation of the drive mechanism directly turns the sleeve and the wing arrangement with respect to the body, independently of any forward motion of external conditions of the vehicle. In some embodiments, such a drive mechanism may be provided in addition to the aforementioned embodiment of actuation mechanism that comprises aerodynamic elements coupled to said wing arrangement.

The vehicle may further comprise a suitable control system for controlling operation of said actuation mechanism. The control system may comprise a suitable controller operatively connected to suitable sensors and configured for controlling operation of said actuation mechanism and to provide said desired first angular displacement via a suitable control system using inputs from said sensors. The control system may be an open loop control system, or a closed loop control system. Such sensors may comprise, for example, inertial sensors and/or velocity sensors for respectively sensing acceleration and/or velocity of the vehicle, and wing arrangement roll angle sensors for sensing the roll angle of the wing arrangement relative to the body about the longitudinal axis. The control system may further be provided with inputs from a guidance and/or navigation computer configured for determining a desired path for the air vehicle to a desired target location, for example. Alternatively, and in some embodiments, the actuation mechanism in the form of said ailerons may be configured for providing a predetermined aileron differential deflection in one sense for a certain time period and then reversing the deflection for another time period, followed by repositioning the ailerons in the neutral datum position, for providing a particular angular displacement for the wing arrangement with respect to the body, in an open control loop manner. Alternatively, and in some embodiments in which the actuation mechanism comprises said drive mechanism, the drive mechanism may be preprogrammed or otherwise controllable to provide a preset angular displacement for the wing arrangement with respect to the body, in an open control loop manner.

In at least some embodiments of the invention, the wing arrangement is a pivot wing and is pivotably mounted to said sleeve via a pivot arrangement having a pivoting axis, said pivoting axis being generally orthogonal with respect to said longitudinal axis, and wherein the wing arrangement is configured for being pivotably rotated about said pivot axis between a stowed configuration, in which a span of the wing arrangement, which may be taken to refer to an imaginary line joining two corresponding points at the wing tips, is in general parallel relationship with the longitudinal axis, and a deployed configuration in which said span is in a general orthogonal relationship with respect to said longitudinal axis. For example, the body may comprise a plurality of lugs for engaging the vehicle to suitable mounting positions of a carrier vehicle or the like. In the stowed configuration, the wing arrangement may be angularly displaced from said lugs with respect to said longitudinal axis by a second angular displacement. In the stowed configuration, said second angular displacement may be at least sufficient to enable the wing arrangement to clear the lugs.

In at least some embodiments, the wing arrangement is pivotably rotatable about said pivot axis between said stowed configuration and said deployed configuration by means of suitable aerodynamic forces selectively generated by said wing arrangement. For this purpose, the wing arrangement comprises at least one aerodynamic element configured for providing an aerodynamically induced turning moment about said pivot axis, at least when said vehicle is in flight. The aerodynamic element comprises at least one aileron mounted to said wing arrangement, and this may be one of the two ailerons which are comprised in the actuation mechanism of at least some such embodiments. The turning moment, which may include a yaw and/or pitch moment, may be generated by increasing the drag of one half of the wing arrangement with respect to the other half, by deflecting one aileron in an appropriate manner, for example. A feature of the actuation mechanism based on such ailerons or flaperons is that deployment of the wing arrangement may be provided in a relatively simple and effective manner.

Alternatively, other suitable mechanisms may be provided for automatically and selectively deploying the wing arrangement.

A feature of at least some such embodiments of the invention is that the wing arrangement may be stowed in a compact configuration while not interfering in any way with the lugs or mounting units of support struts or the like comprised in the aircraft or the like. Thus, standard lugs may be provided.

In other embodiments, the wing arrangement may be fixedly mounted to said sleeve.

In at least some embodiments, the sleeve may be replaced with a body plug that is configured for rotating with respect to a forward body portion and/or a rear body portion, mutatis mutandis.

The actuation mechanism is further configured for rotating said sleeve such as to roll said wing arrangement about said body, with respect to said longitudinal axis, to a position generally aligned with said upper portion of the body, during, before or after deployment of said wing arrangement to said deployed position.

In at least one application, the air vehicle is configured to execute a turn maneuver, wherein in said turn maneuver the vehicle is operated to enable said wing arrangement to provide an aerodynamic lift force required for the maneuver and wherein said wing arrangement is actively rotated with respect to said body about said longitudinal axis by said actuation mechanism such as to provide the required vector for the lift force for said maneuver. The turn maneuver may be executed while substantially unaffecting the roll orientation of said body with respect to the Earth. For example, in such a turn maneuver the body undergoes a slide to turn maneuver while simultaneously the wing arrangement undergoes a bank to turn (BTT) maneuver.

The required lift force for the turn maneuver may be provided in a number of ways.

In any case, the vehicle is further configured for selectively controlling a lift force generated by said wing arrangement.

For example, the vehicle may comprise a suitable arrangement for selectively increasing an angle of attack of said wing arrangement with respect to said body. Additionally or alternatively, the wing arrangement comprises at least one of leading edge slats, flaps, ailerons, variable camber, or any other suitable mechanism, configured for operating in a manner to control lift force generated by said wing arrangement. Any one of flaps or ailerons, may be, for example, in the form of flaperons. Additionally or alternatively, the direction control arrangement is configured for providing at least one of a suitable yaw, for example a yaw movement or yaw moment, and a suitable pitch, for example a pitch movement or a pitch moment to said vehicle such as to provide an incidence angle to the wing arrangement with respect to a direction of motion of the vehicle, said incidence angle being such as to enable said lift force to be generated by said wing arrangement.

According to a second aspect of the invention, there is provided a method for operating an air vehicle, comprising (a) providing an air vehicle as defined according to the first aspect of the invention;

(b) controllably rotating said wing arrangement with respect to said body about said longitudinal axis through a desired angular displacement.

According to at least this aspect of the invention, step (b) includes selectively and controllably rotating said wing arrangement with respect to said body through at least said desired angular displacement about said longitudinal axis, independently of operation of said direction control arrangement of the air vehicle.

According to al least some embodiments, in step (b) an aerodynamic rolling moment is induced by the wing arrangement to rotate said wing arrangement with respect to said body about said longitudinal axis through a desired angular displacement.

In one application, the method is particularly for executing a turn maneuver, wherein said wing arrangement is actively rolled with respect to said body about said longitudinal axis through a desired said first angular displacement, such as to provide a required vector for the lift force for carrying out said maneuver. The turn maneuver may be executed while substantially unaffecting the roll orientation of said body with respect to the Earth.

Optionally, the said first angular displacement (which provides a desired lift vector) and said lift force are controlled via a suitable control responsive to inputs including at least one of inertial data of the vehicle, homing data, and roll angle of the wing arrangement. In some embodiments, closed loop control may be used for controlling first angular displacement and said lift force. Alternatively, open loop control may be used for controlling first angular displacement and said lift force.

In another application, the method is further directed to executing a deployment maneuver, wherein said wing arrangement is a pivot wing and comprises a stowed configuration having a pivot axis thereof at an angle to said longitudinal axis, and concurrent with or subsequent to said rotation, the wing arrangement is pivoted so as to align the axis thereof generally orthogonally to said longitudinal axis.

Optionally, the rotational orientation of said body with respect to said longitudinal axis may be maintained substantially fixed during said maneuver.

Thus, according to at least some aspects of the invention, the sleeve and the wing arrangement are not passively turned as a result of executing a turning maneuver, in response to the aerodynamic forces applied to the wing arrangement that are generated as a result of implementing a change in the direction of the air vehicle using other means. Rather, the rotationally mounted wing arrangement is actively and controllably rotated as desired, i.e. directly rotated as desired, for example to a position that provides the force vector required for executing the maneuver. In other words, an actuation arrangement or mechanism is provided for directly driving the rotation of the wing arrangement relative to the body, that is independent of and generally precedes the maneuver. Thus, the active rolling of the wing arrangement drives the turning maneuver, rather than the maneuver driving the rolling of the wing arrangement.

A feature of at least some embodiments of the invention is that BTT maneuvers can be executed with respect to the wing arrangement, while enabling the vehicle body to maintain the same orientation, or indeed any desired orientation, with respect to its longitudinal axis in roll, for example such that the same part of the vehicle body faces the Earth or in any other fixed direction. Another feature at least some embodiments of the invention is that the required lift vector for the maneuver may be provided relatively quickly, relative to having to roll the full vehicle for a full BTT maneuver, as a smaller moment of inertia is involved—the wing arrangement and sleeve as opposed to the full vehicle.

By actively rolling the wing arrangement to the required roll angle for a particular maneuver, the maneuver can be performed in a fast, efficient and controllable manner. This feature also enables performance of a homing mission, for example, where the vehicle needs to be steered to home onto a target while the target is constantly moving and changing direction.

According to a third aspect of the invention, there is provided an air vehicle, comprising:

a body having a longitudinal axis;

a wing arrangement rotatably mounted to said body and configured for enabling relative rotation between said body and said wing arrangement about said longitudinal axis;

direction control arrangement for controlling the direction of motion of the body; and a pivot arrangement having a pivoting axis, said pivoting axis being generally orthogonal with respect to said longitudinal axis, wherein the wing arrangement is configured for being pivotably rotated about said pivot axis between a stowed configuration, in which a span of the wing arrangement is in general parallel relationship with the longitudinal axis, and a deployed configuration in which said span is in a general orthogonal relationship with respect to said longitudinal axis.

The air vehicle according to the third aspect of the invention comprises elements and features as disclosed herein for the first aspect and second aspect of the invention, mutatis mutandis.

For example, the body may comprise suitable mounting means, such as for example a plurality of lugs, for engaging the vehicle to suitable mounting positions of a carrier vehicle or the like. In the stowed configuration, said wing arrangement may be angularly displaced from said lugs with respect to said longitudinal axis by a second angular displacement. In the stowed configuration, said wing arrangement may be angularly displaced from said lugs with respect to said longitudinal axis by a second angular displacement.

The wing arrangement may be pivotably rotatable about said pivot axis between said stowed configuration and said deployed configuration by means of suitable aerodynamic forces selectively generated by said wing arrangement. The wing arrangement may be configured for, or may comprise at least one aerodynamic element configured for, providing an aerodynamically induced turning moment about said pivot axis, at least when said vehicle is in flight, Such an aerodynamic element may comprise at least one aileron mounted to said wing arrangement.

The wing arrangement may be rotatably mounted to said body via a sleeve configured for rotation about said longitudinal axis with respect to said body, and wherein said wing arrangement is mounted to said sleeve for enabling controllable rotation therewith about said longitudinal axis.

The vehicle may further comprise an actuation mechanism coupled to the wing arrangement and operable for selectively and controllably rotating said wing arrangement with respect to said body through a desired first angular displacement about said longitudinal axis. The actuation mechanism may be configured for rotating said sleeve such as to roll said wing arrangement about said body, with respect to said longitudinal axis, to a position generally aligned with said upper portion of the body, during deployment of said wing arrangement to said deployed position. The actuation mechanism may be provided by the wing arrangement, which is configured for controllably and selectively inducing an aerodynamically generated rolling moment to said wing arrangement with respect to said body about said longitudinal axis. Alternatively, the actuation mechanism may comprise a drive mechanism.

According to at least the third aspect of the invention, the said actuation mechanism is different from the said direction control arrangement, and/or said actuation mechanism is configured for selectively and controllably rotating said wing arrangement with respect to said body through at least said desired first angular displacement about said longitudinal axis, independently of operation of said direction control arrangement.

BRIEF DESCRIPTION OF THE DRAWINGS

In order to understand the invention and to see how it may be carried out in practice, several embodiments will now be described, by way of non-limiting examples only, with reference to the accompanying drawings, in which:

FIG. 1(*a*) illustrates a front view of the embodiment of FIG. 1 in stowed or captive carry configuration, taken along direction X.

DETAILED DESCRIPTION OF THE INVENTION

Figure 1A:
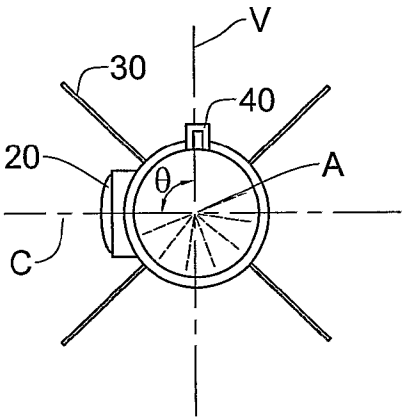
FIG. 1 is a schematic representation illustrating in perspective view an air vehicle according to a first embodiment of the invention with the wing in a bank position for maneuvering.
Figure 1:
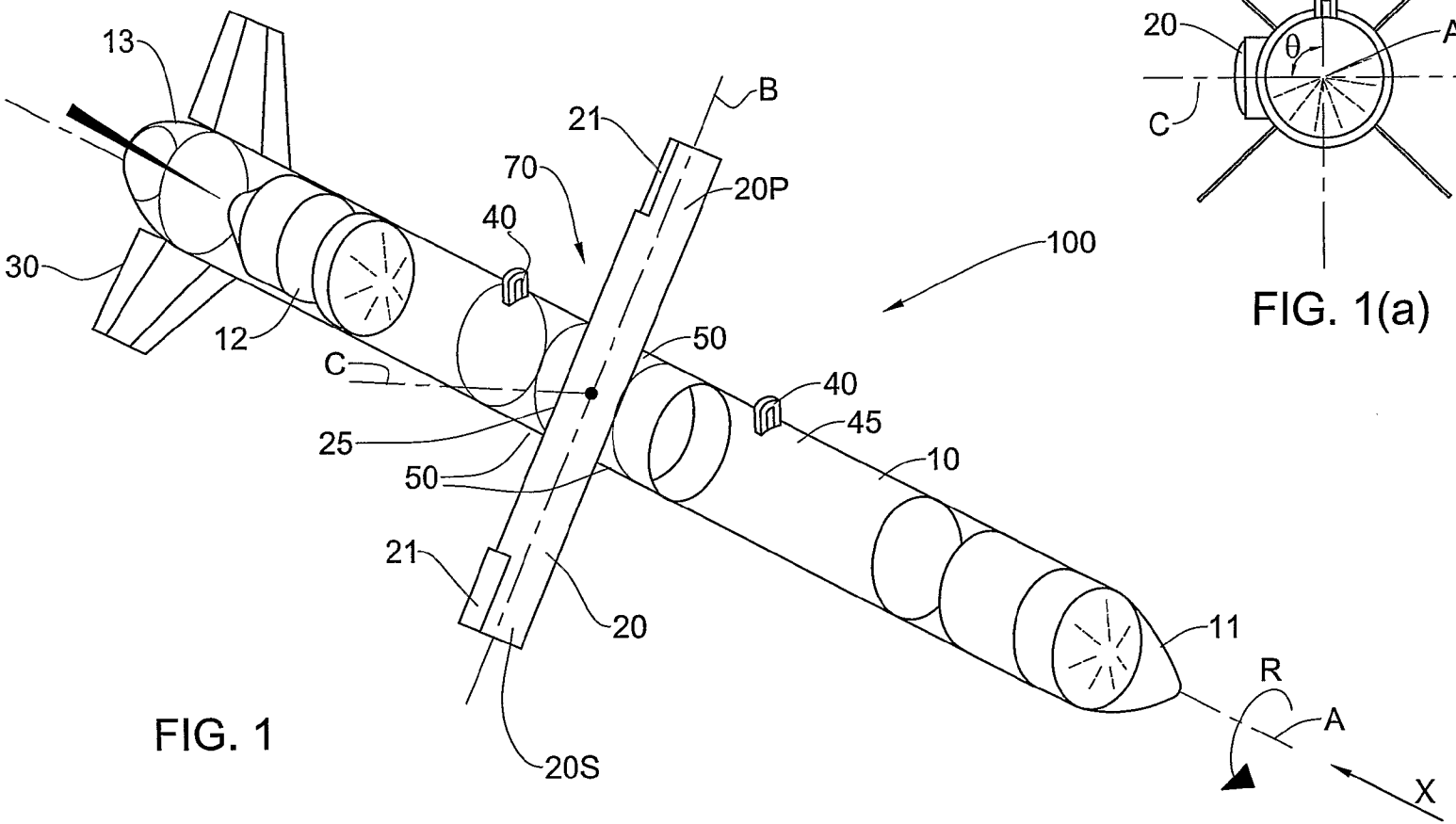

Referring to FIGS. 1 and 1(*a*), an air vehicle according to a first embodiment of the invention is generally designated with reference numeral 100 and comprises a body 10 and steering assembly 70.

In the illustrated example, the vehicle 100 is an unmanned vehicle such as a guided missile, or the like, though the skilled practitioner appreciates that the invention is also applicable to other types of air vehicles, including manned vehicles, mutatis mutandis.

Body 10 comprises an elongate fuselage having a longitudinal centerline or axis A. Axis A is generally aligned with the direction of forward motion of the body 10. The fuselage may comprise a relatively pointed or rounded nose 11 and an aft end 13, and may comprise a generally uniform circular cross-section.

In variations of this embodiment, the fuselage may comprise a non-circular cross-section, for example oval, polygonal etc., and may optionally comprise a faceted outer surface. In such embodiments, a portion of the fuselage associated with the steering assembly is substantially cylindrical or otherwise adapted for enabling operation of the steering assembly, and suitable fairings may be provided for aerodynamically blending the rest of the fuselage thereto, or at least for aerodynamically blending portions of the fuselage adjacent to the steering assembly.

Referring again to FIGS. 1 and 1(*a*), the vehicle 100 also comprises a flight control unit (not shown) and a propulsion unit or powerplant 12, such as for example one or more of a rocket motor, ramjet, turbojet and so on, for providing propulsion to the vehicle 100. However, in variations of this embodiment, the powerplant 12 may be omitted, and the vehicle 100 may be configured as a gliding vehicle, which is released from a carrier aircraft or other air vehicle. In yet other variations of this embodiment, the vehicle 100 may be suitably configured for being fired from a cannon or the like, or comprising an ejectable rocket propulsion unit, for example, to impart forward velocity to the vehicle 100.

When configured for being deployed from an aircraft or the like (whether or not the vehicle 100 comprises a powerplant 12) the body 10 may comprise suitable standard lugs 40 or the like for releasable engagement with respect to mounting units of support struts or the like comprised in the aircraft or the like. In the illustrated embodiment, the lugs are correspondingly suitably spaced along the direction of axis A on the upper part 45 of the body 10, aligned with a nominal vertical datum plane V, though in variations of this embodiment, the lugs may be located at any suitable location with respect to body 10 in order to enable engagement to the respective mounting arrangement of a carrier vehicle, even if this mounting arrangement may be placed elsewhere on the carrier vehicle rather than on the underside of the fuselage or wings thereof.

The body 10 may also comprise a payload, which may include for example explosives or other ordinance, and/or sensors such as radar, electro-optic sensors, surveillance equipment, communication means and so on, which may be housed in the nose 11, for example.

In particular, the vehicle 100 may comprise one or more directionally sensitive sensors (not shown), regarding which it may be desired that the sensors are aligned in a particular direction, for example in a downwards direction aligned with plane V, even when executing banking maneuvers, facing the Earth. Such sensors may be of particular use during homing maneuvers, for example, where the vehicle 100 may be configured for tracking a target autonomously.

The vehicle comprises direction control mechanism in the form of control fins 30, typically in cruciform "X" or "+" arrangement, and located at the aft end 13 of the body 10, configured for providing longitudinal and lateral stability and for controlling the attitude of the axis A in pitch and yaw with respect to the flight path direction. The control fins 30 are also configured for controlling the roll orientation of the body 10 independently of the position of the steering assembly 70. In variations of the embodiment, the fins 30 may be supplemented with canards or the like (not shown) located at or near the nose 11 or any other suitable forward location of the vehicle—for example, the canards may control the pitch and yaw of the fuselage, while the fins 30 control the roll thereof. In yet other variations of this embodiment, the control fins 30 may be removed, and pitch, yaw and roll control is provided by canards, while the steering assembly is located sufficiently aft on the body to provide the required stability. In alternative embodiments, the fins 30 may be replaced or supplemented with any other suitable flight longitudinal stabilizing and attitude steering system. In alternative embodiments, the powerplant 12 may be configured for providing thrust vector control (TVC).

Steering assembly 70 comprises a wing arrangement rotatably mounted to the body 10 with respect to said longitudinal axis A, and an actuation mechanism operable for selectively and controllably rotating said wing arrangement with respect to said body 10 through at least a desired first angular displacement about said longitudinal axis A. In particular, steering assembly 70 comprises wing 20 and a rolling mechanism including sleeve 50.

As will become clearer herein, the said actuation mechanism is different from the direction control mechanism, (also referred to interchangeably herein as the direction control arrangement), and/or said actuation mechanism is configured for selectively and controllably rotating said wing arrangement with respect to said body through at least said desired first angular displacement about said longitudinal axis, independently of operation of said direction control arrangement.

In this embodiment, the wing 20 may be configured for providing a required lift force when the body 10 is pitched to provide the wing 20 with a desired incidence angle (angle of attack) with respect to the direction of flight.

As will be disclosed in greater detail below, the steering assembly 70 is configured for steering the vehicle 100, at least in executing bank to turn maneuvers for the wing 20, to controllably change the flight path of the vehicle 100.

In this embodiment, the wing 20 is of substantially uniform section, having substantially zero taper, zero sweep and zero dihedral. The skilled practitioner appreciates, however, that in variations of the embodiment the wing 20 may have any desired taper, sweep (positive or negative) and/or dihedral, generally depending, inter alia, on the manner in which the vehicle is to be carried and deployed, whether the vehicle is required to have a stowed configuration, and so on, for example.

The wing 20 is mounted to the body 10 via sleeve 50 that is rotatable with respect to the body about axis A. In this embodiment, the sleeve 50 is freely rotatable with respect to the body about axis A, to enable relative rotational movement between the sleeve and the body, and for this purpose, the sleeve 50 may comprise one or more suitable bearings 55, each having a fixed part on the body 10 and a movable part on the sleeve 50. Bearing 55 may be, for example, a mechanical bearing, including rollers, balls or a frictionless material in between the parts rotating in relatively opposite directions, typically comprising moving and stationary parts, or may be for example an air bearing, in which pressurized air is provided between the moving and stationary parts, or may include any other suitable bearing configuration. Where an air bearing is used, pressurized air may be obtained by scooping air and feeding the same to the bearing as the vehicle follows a flight path at high speed, for example.

In this embodiment the sleeve 50 may be configured for providing a full roll rotation of 360°, but in variations of this embodiment limited rolling may be provided, for example any desired roll angle between ±180°, or between ±90°, or between ±70°, or within any other suitable angular range with respect to a datum, for example the vertical plane V.

In this embodiment, the wing 20 is formed as a unitary wing structure that, at least during the flight mode portion of vehicle operation, is located on or otherwise overlaid with respect to upper part 45 of the body 10 such as to provide lift thereto while carrying the body 10 below it. The wing 20 is thus in general tangential relationship with respect to the sleeve 50.

Figure 4:
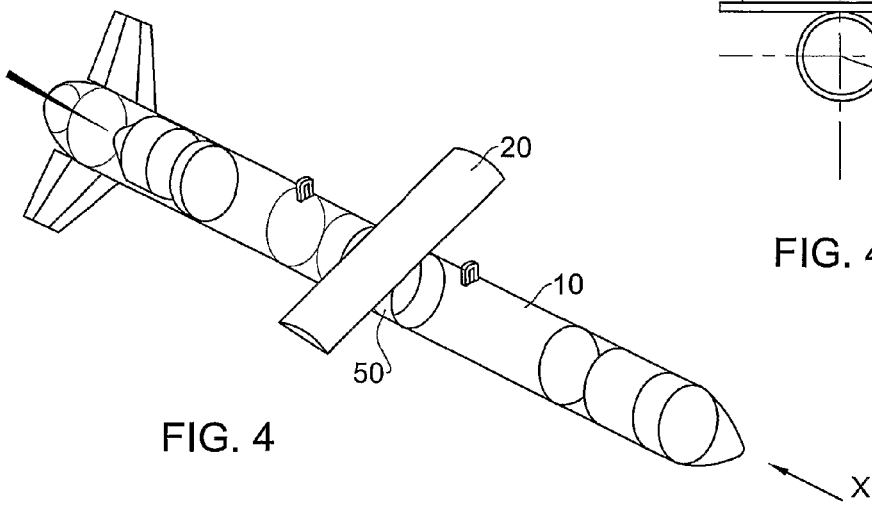
FIGS. 4 and 4(*a*) illustrate in perspective view and in front view, respectively, the embodiment of FIG. 1 in deployed configuration.
Figure 4A:
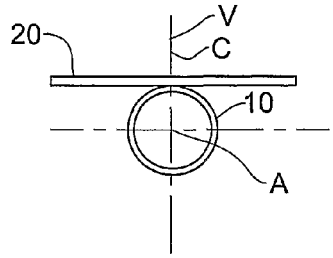

In the deployed configuration, the wing 20 has a wing arrangement including a port wing portion, 20*p*, and a starboard wing portion 20*s*. Furthermore, the wing 20 is configured as a movable, pivot wing, pivotably mounted to the sleeve 50 via a central pivot 25. Wing 20 is thus capable of pivoting about an axis C, at least through a pivoting angular range, wherein axis C, in the illustrated embodiment, is generally orthogonal to longitudinal axis A (FIG. 1(*a*)). In the illustrated embodiment, axis C also intersects longitudinal axis A generally orthogonal thereto (FIG. 1(*a*)). The wing 20 may be pivotably rotated as a single body from a stowed position or configuration (FIGS. 2, 2(*a*)), also referred to herein as a captive carry position, in which the span or longitudinal axis B of the wing 20 is substantially aligned with the axis A and laterally displaced therefrom, to a deployed position or configuration (FIGS. 4, 4(*a*)), also referred to herein as the flight position, in which the axis B is substantially orthogonal to axis A and enables lift to be generated. Thus, the pivoting angular range required for the deployment operation may be about 90°, for example.

In both the stowed and deployed positions, the longitudinal axis B of the wing 20 is substantially is generally orthogonal to pivot axis C.

Figure 2:
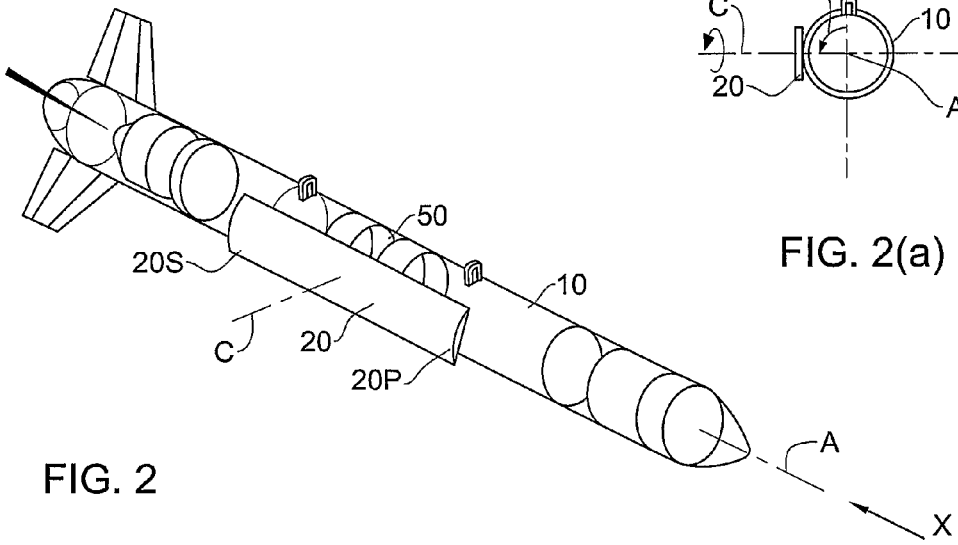
FIGS. 2 and 2(*a*) illustrate in perspective view and in front view, respectively, the embodiment of FIG. 1 in stowed or captive carry configuration.
Figure 2A:
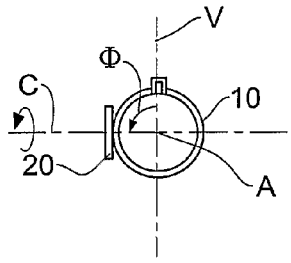

A suitable locking mechanism may be provided for locking the wing 20 in the stowed position, and the same or another locking mechanism may be provided for locking the wing 20 in the deployed position with respect to the sleeve 50. As illustrated in FIGS. 2 and 2(*a*) in particular, in the stowed position the wing 20 is stowed along a side of the body 10, and thus axis C of pivot 25 lies at an angle $\Phi_{w\,b}$ with respect to the position of the lugs 40 about axis A, i.e., at an angle $\Phi_{w\,b}$ to datum plane V, this angle being defined over a plane substantially orthogonal to the axis A, wherein $\Phi_{w\,b}$, may be any suitable angle between 0° and ±180°.

Figure 5:
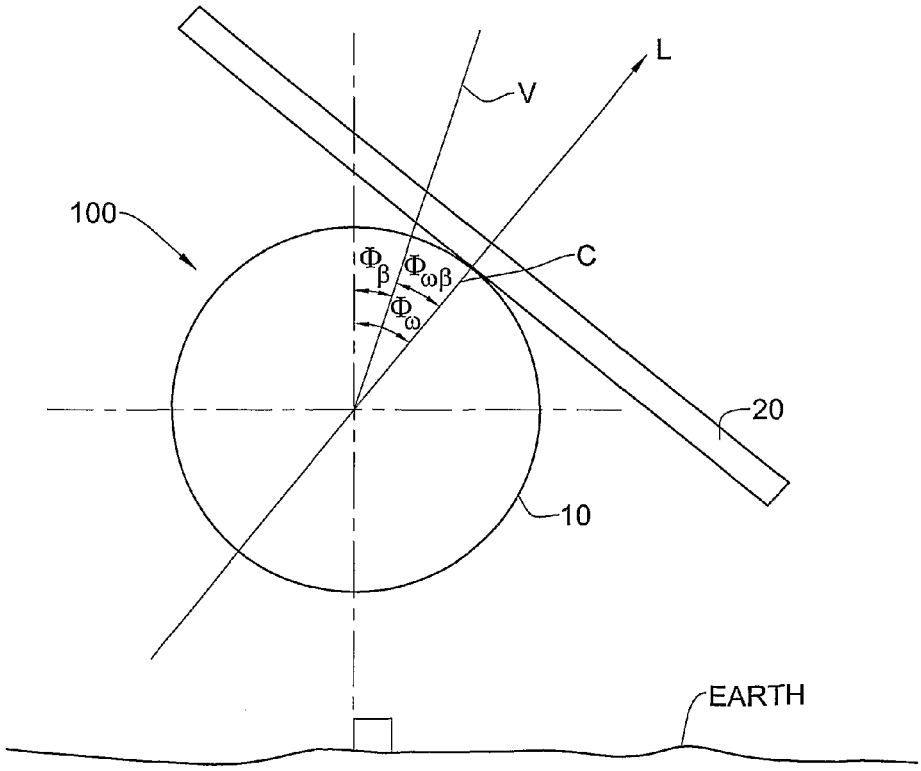
FIG. 5 schematically illustrates lifting force generated in a desired direction when the wing of the embodiment of FIG. 1 is actively rotated about the longitudinal axis, for example during a wing BTT maneuver

Referring to FIG. 5, angle $\Phi_b$ refers to the roll angle of the body relative to an absolute vertical, i.e., with respect to the Earth, and angle $\Phi_w$ refers to the roll angle of the wing 20 relative to the Earth. Thus:

$$\text{angle } \Phi_w = \text{angle } \Phi_b + \text{angle } \Phi_{wb}$$

In this embodiment, angle $\Phi_{wb}$ is about 90° from vertical datum V in the stowed position, though in variations of the embodiment, angle $\Phi_w$ may be at −90°, or at 180°, or indeed at any other suitable angle between 0° and ±180° that provides a suitable clearance of the stowed wing with respect to the lugs 40 and to the mounting units of the carrier aircraft, including carrying hook, sway braces and so on. A feature of this configuration is that it enables the upper portion 45 of the body 10 to remain clear of the wing 20, allowing engagement of the lugs 40 to a carrier vehicle or the like, without interfering with the wing 20 and without complex mechanical arrangements through the stowed wing or special non-standard lug arrangements, which could otherwise be required in the wing is topmost in the stowed position.

In this embodiment, the actuation mechanism is provided by the wing 20, in particular the controllable aerodynamic elements of the wing 20 itself that are configured for directly providing a rotational force on the wing. Thus, in this embodiment, the motive force for rotating the sleeve 50 with respect to axis A is aerodynamically generated by actively controlling and activating aerodynamic elements in the wings. In this connection, the port portion, 20*p* and the starboard portion 20*s* each comprises an aileron/flap, herein referred to as a flaperon and designated with reference numeral 21, or other control surface capable of providing at least differential lift force between the two wing portions, as well as a flap function.

Whenever the flaperons 21 are operated as ailerons and are differentially actuated to provide differential lift in the wing 20, a roll moment is induced, and the wing 20 rolls about axis A via rotation of the sleeve 50, and does not roll the body 10 together with the wing 20. The flaperons 21 are suitably controlled by the control unit to provide the desired angular rotation of the wing 20 (roll angle $\Phi_{wb}$) with respect to the body 10, thus providing the desired roll angle $\Phi_w$ with respect to the Earth. For example, and referring to FIG. 1, when flaperon 21 of port wing portion 20*p* is deflected positively, and flaperon 21 of starboard wing portion 20*s* is deflected negatively, the wing 20 and sleeve 50 together rotate in an anticlockwise direction R, as seen in direction X along axis A.

A closed loop control system is provided for the control unit, wherein a suitable angular position sensor (not shown) provides the real-time angular roll position of the wing 20 (or of axis C, for example, i.e., angle $\Phi_{wb}$) or of the sleeve 50 with respect to a datum such as datum plane V. This information is fed to the control unit, which correspondingly controls the operation of the flaperons 21 such as to achieve the desired angular disposition without overshoot.

In this embodiment, each flaperon 21 may be operated independently of the other, and thus it is possible, for example, to provide deflection to one flaperon, while maintaining the other flaperon in a non-deflected position, for example. This mode of operation also provides a yaw and/or pitch moment to the wing 20, and may be of particular use during deployment of the wing to deployed configuration, for example, as will be disclosed in more detail below.

Optionally, the ailerons 21 may be operated to provide different deflections in the same direction, for example different positive or different negative deflections, to provide a roll moment and a yaw moment to the wing 20, and at the same time may provide a change in the lift and/or speed and/or drag.

In this embodiment, the flaperons 21 can also be operated as flaps and/or airbrakes, by providing the same deflections to change lift of the wing and/or reduce speed, as desired.

In alternative variations of this embodiment, the flap and aileron functions of the flaperons may be provided by separate ailerons and flaps, mutatis mutandis.

The steering assembly 70 is controllably movable and configured for at least partially steering the vehicle 100, and thus to change the flight path direction of the vehicle 100 as commanded by the control unit.

The vehicle 100 has a number of operational modes based on active rotation of sleeve 50 about axis A, for example including the following:

Wing Deployment Mode

Figure 3:
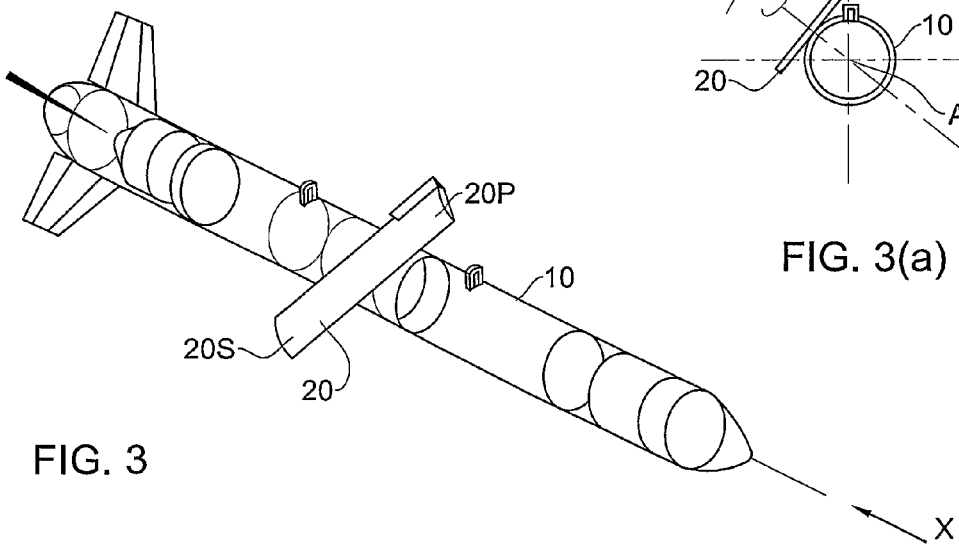
FIGS. 3 and 3(*a*) illustrate in perspective view and in front view, respectively, the embodiment of FIG. 1 during deployment.
Figure 3A:
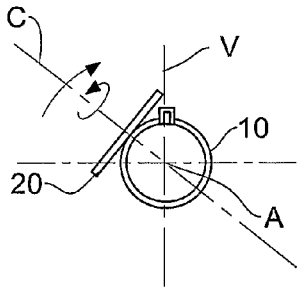

For the purpose of wing deployment, the sleeve 50 may be rotated by 90° from its stowed position (or indeed through whatever angle $\Phi_{wb}$ the axis C is oriented with respect to datum V in the stowed position to at least clear the lugs 40) so that the wing 20 is rotated back to assume a position on the upper portion of the body 10, such that axis C is aligned with datum V. Thus, and referring to FIGS. 2 to 4, when it is desired to deploy the wing 20, this is unlocked from the stowed position illustrated in FIGS. 2 and 2(*a*) so that the wing 20 pivots about pivot 25 such that the span or axis B is substantially orthogonal to axis A.

For this purpose, rotation of the wing about axis C during deployment mode is accomplished aerodynamically in the illustrated embodiment. Referring to FIGS. 2, 2(*a*), 3 and 3(*a*), the flaperon 21 of port wing portion 21*p*, which in the stowed position is forward of the starboard wing portion 20*s*, may be provided with a negative deflection (or indeed a positive deflection, instead, mutatis mutandis), while the flaperon 21 of the starboard wing remains in neutral deflection. This results in more drag being generated by the port wing portion 21*p* than by the starboard wing portion 21*s*, inducing a couple about axis C, providing a rotation to the wing 20. The rotational angle of the wing is monitored by the control unit, which controls and provides a deflection of the other flaperon 21 to induce an appropriate drag on the starboard wing portion 21*s* to stop the rotation when the wing assumes its position substantially orthogonal to axis A. At the same time, the deflections of the flaperons also serve to rotate the steering assembly 70 so that the wing 20 is above the body 10 by the time the rotation stops. Thus, the differential deflection of the flaperons 21 may be controlled to provide the desired rotation and bring the wing 20 the position where the longitudinal axis B of the wing 20 is substantially orthogonal to axis A without overshoot. A mechanical stop may be provided to limit the rotation of the wing 20 about pivot 25 to the deployed position, and in any case, actuation of the flaperons 21 in deployment mode may be terminated after the wing 20 has been locked in this position.

In alternative variations of this embodiment, a suitable mechanical arrangement may be provided to induce a turning motion to the wing 20 about pivot axis C, for example a spring or the like.

After the wing 20 has been rotated about axis C to attain a substantially orthogonal relationship with respect to axis A, axis C of the pivot 25 is still 90° (or the aforesaid alternate angle $\Phi_{wb}$, mutatis mutandis) from the vertical datum V, and the wing 20 is substantially vertical. The flaperons 21 are operated by the control unit so as to induce a roll moment to the wing 20, which accordingly rotates with respect to axis A via sleeve 50, such as to roll the wing by 90° (or the aforesaid alternate angle $\Phi_{wb}$, mutatis mutandis) with respect to the body so that the wing 20 assumes a substantially horizontal position on the upper part 45 of the body 10 (FIGS. 4 and 4(*a*)).

Optionally, the flaperons 21 may be operated such as to provide concurrently with the rotation of the wing about axis C with respect to the body, also the roll rotation of the wing 20, i.e., rotation of the pivot 25 with respect to axis A, but in a manner such as not to collide with the lugs 40.

Bank-to-Turn (BTT) Maneuvering Mode

In BTT, the direction of motion of the vehicle 100 is turned, typically along a horizontal plane or an inclined plane, while the vehicle executes a roll. In embodiments of the invention, this roll is executed by the wing 20 only, while the body 10 remains unrolled, and thus essentially maintains its orientation with respect to the Earth, for example, facilitating homing maneuvers, for example, and/or ensuring that communication antennas, ground following radar, altimeter equipment and so on are maintained oriented in the same direction with respect to the Earth, irrespective of the roll angle of the wing 20. Thus, the BTT maneuver is essentially carried out by the wing 20, while the body simultaneously undergoes a slide to turn maneuver. Nevertheless, the term BTT is also used herein to refer to such a combination.

In general, each BTT maneuver requires an aerodynamic force to act on the vehicle 100 in a particular direction given by the lift vector to drive the maneuver in order to turn the vehicle in the desired direction. In at least some applications of the invention, the vehicle 100 may be configured for homing with respect to a moving target.

The turning force is provided by the wing 20, which is banked to a required roll angle such as to provide a lifting force L that has the required lift vector, i.e., is in the required direction to execute the maneuver. In any required maneuver, for example to follow a particular target that the vehicle 100 is homing on, it may be required to provide an overall acceleration $A_p$ to the vehicle 100 relative to the Earth, and this acceleration may be resolved into an azimuth acceleration component $A_Y$ and an elevation acceleration component $A_Z$. The required acceleration $A_p$ may be calculated by the control unit, based on homing laws and rules as are known in the art. The required roll angle $\Phi_w$ for the wing 20 is then calculated by the control unit such as to provide the required lift vector, and thus the corresponding ratio between the azimuth acceleration component $A_Y$ and the elevation acceleration component $A_Z$, the greater the ratio $A_Y/A_Z$, the greater the roll angle $\Phi_w$ that is required. The control unit then controls operation of the steering assembly 70 so as to provide the required roll angle $\Phi_w$ to the wing 20, and the wing is actively rolled by aerodynamic actuation via the flaperons (or alternatively via mechanical actuation in embodiments which are actuated in this manner) to provide this roll angle. The actual roll angle is constantly monitored using suitable sensors while the wing 20 is being rolled, and the steering assembly 70 is controlled via closed loop control based on such monitoring, such as to achieve the required roll angle as quickly as possible with minimum or zero overshoot. The required roll angle and required acceleration are continuously updated, and modified in real time via closed loop control.

Thus, as the steering assembly 70 and wing 20 execute a BTT maneuver, the body 10 concurrently completes the maneuver in a slide-to-turn (STT) manner, without rolling.

When a BTT maneuver is being executed and the wing 20 is being turned to the required orientation and thus lift vector for the maneuver, the pitch of the wing 20 needs to be changed to provide the lift force as required for the maneuver. This may be done in a number of different ways.

For example, the required pitch is provided by operating the flaperons 21 as flaps and deflecting the same by an amount sufficient to provide the required change in incident angle $\alpha$, thereby minimizing or avoiding a pitch or yaw maneuver generated by the body 10. This may be particularly useful when executing large BTT homing maneuvers, for example.

Otherwise, the incident angle $\alpha$ to the direction of motion of the vehicle 100 itself, and thus axis A thereof, may be changed in an STT maneuver by controlling the fins 30, such that the velocity vector is perpendicular to the wing, and there is no incident angle by the wing axis B.

Alternatively, the wing may be mounted to the sleeve via a joint or the like that allows the wing to be pitched with respect to the sleeve as a single body or monoblock, for example in a manner similar to that disclosed in U.S. Pat. No. 2,788,182, mutatis mutandis, the contents of which are incorporated herein in their entirety.

Alternatively, the wing may comprise leading edge slats and/or may be configured with a variable camber.

Optionally, the vehicle 100 may be configured for providing the required lift using any combination of the above aspects, for example by changing the angle of attack of the body 10 relative to the direction of motion and/or relative to the body, and/or, providing flap or flaperon deflection.

In alternative variations of the first embodiment, where it is not necessary to provide a stowed mode for the wing 20, the wing 20 may be permanently fixed to the sleeve 50 via a non-pivoting mounting, and optionally may be configured for changing the incidence angle with respect thereto, mutatis mutandis. Such a fixed wing may be mounted to the sleeve to assume an upper position with respect to the fuselage during some flight modes, or alternatively a port wing and a starboard wing may be provided, each being separately mounted to the sleeve at any desired circumferential positions thereon.

Figure 6:
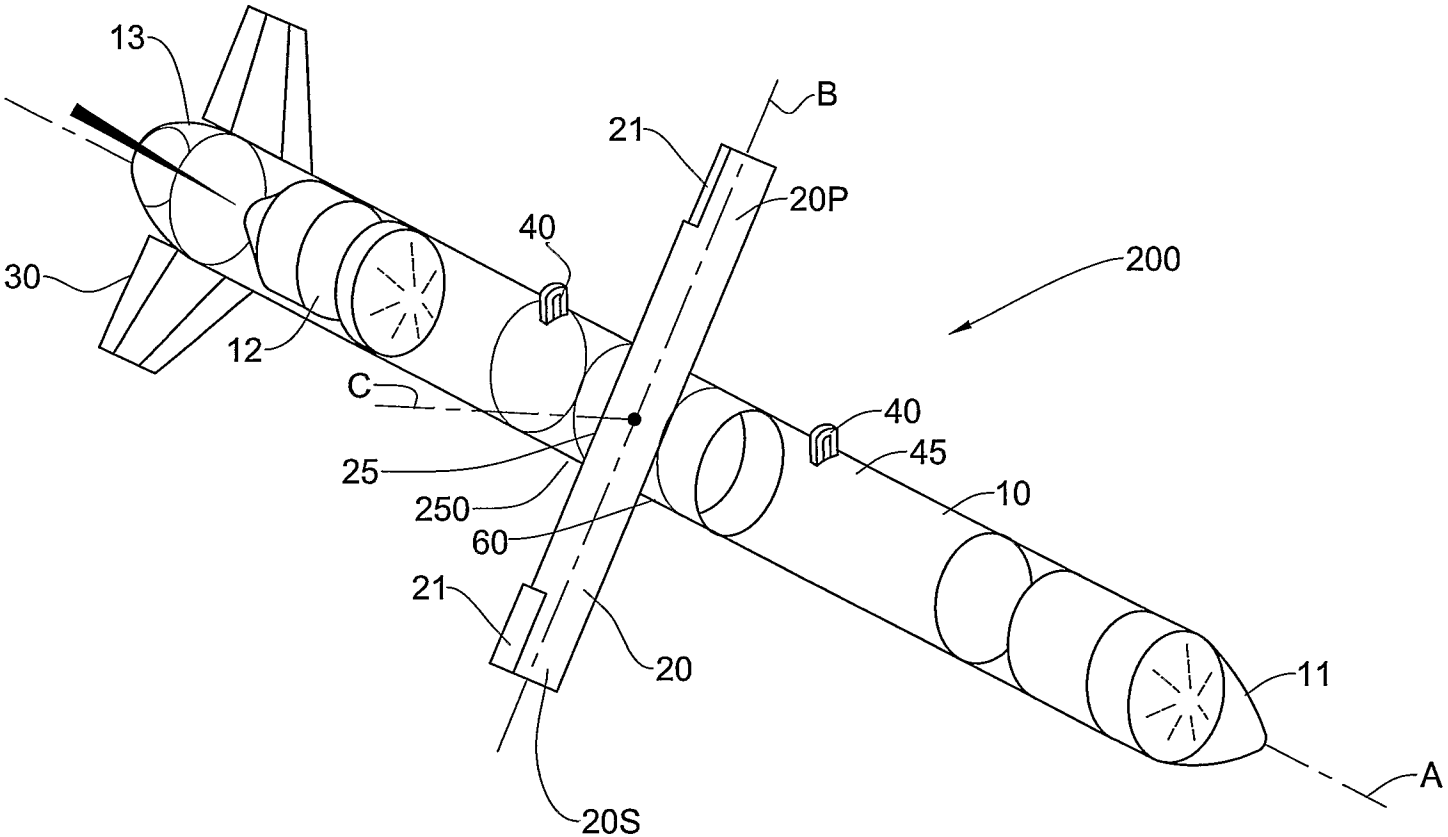
FIG. 6 is a schematic representation illustrating in perspective view an air vehicle according to a second embodiment of the invention.

Referring to FIG. 6, a vehicle according to second embodiment of the invention, generally designated 200, comprises all the elements and features of the first embodiments, mutatis mutandis, with the major difference being that rather than providing a free rotating sleeve, in which aerodynamic or other forces are actively generated by the wing 20 to induce a roll moment, the sleeve 250 in the second embodiment is actuated mechanically for enabling any required rotational movement of the sleeve 250 about axis A to be executed.

Thus, in the second embodiment, vehicle 200 also comprises body 10 (including nose 11, aft end 13 and upper part 45), wing 20 (including a port portion, 20*p*, and a starboard portion 20*s*, and optionally flaperons 21), control fins 30, and one or more of powerplant 12 and lugs 40, optionally in addition to other features, as disclosed for the first embodiment, mutatis mutandis.

Furthermore, the wing 20 may be pivotably mounted to sleeve 250 via pivot 25, in a similar manner to that described for the first embodiment, mutatis mutandis.

Sleeve 250, may be similar to sleeve 50 of the first embodiment, mutatis mutandis, and can also rotate with respect to the body 10 about longitudinal axis A. However, such rotational movement is actuated by means of a suitable drive mechanism 60.

Drive mechanism 60 comprises any suitable mechanical mechanism or arrangement capable of applying a turning couple to the sleeve 250 about axis A, and may optionally be housed within the body 10. For example, drive mechanism 60 may comprise a motor, for example a rotary motor, which is coupled to the sleeve 250 via any suitable mechanical coupling, for example any one of or combination of gears, belts, drive shafts, and so on so as to provide a turning motion thereto. The motor may be electrically powered, for example, or pneumatically or hydraulically powered, or may comprise a fuel driven engine, and so on. Alternatively, a system of levers connected to an internal rim of the sleeve 250 may be actuated by the reciprocal motion of suitable jacks, solenoids, or the like, or any other linear motors for example.

Alternatively, the drive mechanism may be externally mounted with respect to body 10, preferably within a faired housing, and externally coupled to the sleeve 250.

Thus, in wing deployment mode, the sleeve 250 may be rotated by 90° from its stowed position (or indeed through whatever angle $\Phi_{wb}$ the axis C through the pivot 25 is oriented in the stowed position) by being mechanically turned by the mechanism 60. Similarly, in BTT mode, the wing 20 is actively rotated via sleeve 250 directly by the mechanism 60 to assume a desired bank position, and thus enable the BTT maneuver.

Whilst some particular embodiments have been described and illustrated with reference to some particular drawings, the artisan will appreciate that many variations are possible which do not depart from the general scope of the invention, mutatis mutandis.

The invention claimed is:

1. An air vehicle, comprising:

a body having a longitudinal axis;

a wing rotatably mounted to said body with respect to said longitudinal axis, wherein said wing has a wing arrangement including a port wing portion and a starboard wing portion, and said wing arrangement is formed as a unitary wing structure;

direction control arrangement for controlling the direction of motion of the body; and an actuation mechanism operable for selectively and controllably rotating said wing with respect to said body through at least a desired first angular displacement about said longitudinal axis, independently of operation of said direction control arrangement, wherein said wing is rotatably mounted to said body via a rolling mechanism, wherein said rolling mechanism comprises a sleeve configured for rotation about said longitudinal axis with respect to said body, and wherein said wing is mounted to said sleeve for enabling controllable rotation therewith about said longitudinal axis, wherein said wing is mounted in a substantially tangential relationship with respect to said sleeve, and wherein said wing is pivotably mounted to said sleeve via a pivot arrangement having a pivoting axis, said pivoting axis being substantially orthogonal with respect to said longitudinal axis, and wherein the wing is configured for being pivotably rotated about said pivot axis between a stowed configuration, in which a span of the wing is in a substantially parallel relationship with the longitudinal axis, and a deployed configuration in which said span is in a substantially orthogonal relationship with respect to said longitudinal axis.

2. The air vehicle according to claim 1, wherein said sleeve is configured for freely rotating with respect to said body about said longitudinal axis, and said actuation mechanism is comprised in said wing, said actuation mechanism being configured for selectively inducing an aerodynamically generated rolling moment to said wing with respect to said body about said longitudinal axis to provide said at least desired first angular displacement about said longitudinal axis.

3. The air vehicle according to claim 2, wherein said actuation mechanism comprises actuable aerodynamic elements coupled to parts of said wing, said aerodynamic elements comprising ailerons mounted to said wing and controllably operable to selectively induce said aerodynamically generated rolling moment responsive to differential deflection of said ailerons when the vehicle is in a flight regime with respect to said wing.

4. The air vehicle according to claim 2, further comprising a suitable controller operatively connected to suitable sensors and configured for controlling operation of said actuation mechanism and to provide said desired first angular displacement via a suitable control system using inputs from said sensors.

5. The air vehicle according to claim 4, wherein said sensors comprise at least inertial sensors, and roll angle sensors for sensing the roll angle of the wing with respect to said body.

6. The air vehicle according to claim 1, wherein said actuation mechanism comprises a drive mechanism engaged to said sleeve and configured for selectively and controllably driving rotation of said sleeve, together with said wing, with respect to said body about said longitudinal axis through said first angular displacement.

7. The air vehicle according to claim 1, wherein said body comprises a plurality of lugs for engaging the vehicle to suitable mounting positions of a carrier vehicle or the like, and wherein in said stowed configuration, said wing is angularly displaced from said lugs with respect to said longitudinal axis by a second angular displacement.

8. The air vehicle according to claim 1, wherein said wing is pivotably rotatable about said pivot axis between said stowed configuration and said deployed configuration by means of suitable aerodynamic forces selectively generated by said wing, wherein said wing comprises at least one aerodynamic element configured for providing an aerodynamically induced turning moment about said pivot axis, at least when said vehicle is in flight, and wherein said aerodynamic element comprises at least one aileron mounted to said wing.

9. The air vehicle according to claim 1, wherein said actuation mechanism is configured for rotating said sleeve such as to roll said wing about said body, with respect to said longitudinal axis, to a position substantially aligned with said upper portion of the body, during deployment of said wing to said deployed position.

10. The air vehicle according to claim 1, wherein said vehicle is configured to execute a turn maneuver, wherein in said turn maneuver the vehicle is operated to enable said wing to provide an aerodynamic lift force required for the maneuver and wherein said wing is actively rotated with respect to said body about said longitudinal axis by said actuation mechanism such as to provide the required vector for the lift force for said maneuver.

11. The air vehicle according to claim 1, wherein said turn maneuver is executed while substantially unaffecting the roll orientation of said body with respect to the Earth.

12. The air vehicle according to claim 1, wherein said actuation mechanism is different from the said direction control arrangement.

13. A method for operating an air vehicle, comprising (a) providing an air vehicle as defined in claim 1;

(b) controllably rotating said wing with respect to said body about said longitudinal axis through at least said desired first angular displacement.

14. The method according to claim 13, wherein step (b) comprises inducing an aerodynamic rolling moment by the wing to rotate said wing with respect to said body about said longitudinal axis through said desired first angular displacement.

15. The method according to claim 13, wherein said wing is actively rolled with respect to said body about said longitudinal axis through said desired said first angular displacement, such as to provide a required vector for the lift force for carrying out said maneuver.

16. The method according to claim 15, wherein said turn maneuver is executed while substantially unaffecting the roll orientation of said body with respect to the Earth.

17. The method according to claim 13, wherein step (b) includes selectively and controllably rotating said wing with respect to said body through at least said desired angular displacement about said longitudinal axis, independently of operation of said direction control arrangement of the air vehicle.

18. An air vehicle, comprising:

a body having a longitudinal axis;

a wing rotatably mounted to said body and configured for enabling relative rotation between said body and said wing about said longitudinal axis;

direction control arrangement for controlling the direction of motion of the body; and a pivot arrangement having a pivoting axis, said pivoting axis being substantially orthogonal with respect to said longitudinal axis, wherein the wing is configured for being pivotably rotated about said pivot axis between a stowed configuration, in which a span of the wing is in a substantially parallel relationship with the longitudinal axis, and a deployed configuration in which said span is in a substantially orthogonal relationship with respect to said longitudinal axis, and wherein said wing is pivotably rotatable about said pivot axis between said stowed configuration and said deployed configuration by means of suitable aerodynamic forces selectively generated by said wing.

19. The air vehicle according to claim 18, wherein said body comprises suitable mounting arrangement for mounting the air vehicle to a carrier vehicle or the like.

20. The air vehicle according to claim 19, wherein in said stowed configuration, said wing is angularly displaced from said mounting arrangement with respect to said longitudinal axis by a second angular displacement.

21. The air vehicle according to claim 18, wherein said wing comprises at least one aerodynamic element configured for providing an aerodynamically induced turning moment about said pivot axis, at least when said vehicle is in flight, and wherein said aerodynamic element comprises at least one aileron mounted to said wing.

22. The air vehicle according to claim 18, wherein said wing is rotatably mounted to said body via a sleeve configured for rotation about said longitudinal axis with respect to said body, and wherein said wing is mounted to said sleeve for enabling controllable rotation therewith about said longitudinal axis, and further comprising an actuation mechanism coupled to the wing and operable for selectively and controllably rotating said wing with respect to said body through a desired first angular displacement about said longitudinal axis.

23. The air vehicle according to claim 22, wherein said actuation mechanism is configured for rotating said sleeve such as to roll said wing about said body, with respect to said longitudinal axis, to a position substantially aligned with said upper portion of the body, during deployment of said wing to said deployed position.

* * * * *